US012383845B2

(12) United States Patent
Sacha et al.

(10) Patent No.: US 12,383,845 B2
(45) Date of Patent: Aug. 12, 2025

(54) INFLATABLE, EXPANDING SWORD

(71) Applicants: Alexander J. Sacha, Milwaukee, WI (US); Brett A. Arand, Milwaukee, WI (US)

(72) Inventors: Alexander J. Sacha, Milwaukee, WI (US); Brett A. Arand, Milwaukee, WI (US)

( * ) Notice: Subject to any disclaimer, the term of this patent is extended or adjusted under 35 U.S.C. 154(b) by 94 days.

(21) Appl. No.: 17/852,695

(22) Filed: Jun. 29, 2022

(65) Prior Publication Data

US 2022/0410026 A1 Dec. 29, 2022

Related U.S. Application Data

(60) Provisional application No. 63/216,069, filed on Jun. 29, 2021.

(51) Int. Cl.
*A63H 33/30* (2006.01)
*A63H 33/00* (2006.01)

(52) U.S. Cl.
CPC ..... *A63H 33/009* (2013.01)

(58) Field of Classification Search
CPC ..... A63H 33/009
See application file for complete search history.

(56) References Cited

U.S. PATENT DOCUMENTS 2,669,062 A * 2/1954 Baggott ..... A63H 33/009 463/47.1
3,037,320 A * 6/1962 Powell ..... A63H 33/009 446/487
4,678,450 A * 7/1987 Scolari ..... A63H 33/009 362/202
5,145,446 A * 9/1992 Kuo ..... A63H 5/04 446/485
5,256,099 A 10/1993 Rudell
5,279,340 A * 1/1994 Scherr ..... A63H 27/10 53/469
6,030,272 A * 2/2000 Hu ..... A63H 33/009 446/233
6,036,576 A * 3/2000 Colon, Jr. ..... A63H 33/009 446/485
6,540,627 B1 * 4/2003 Leal ..... A63B 59/50 446/220
7,476,141 B2 1/2009 Hom
7,621,650 B2 * 11/2009 Nalitchaev ..... E01F 9/617 446/226
8,089,458 B2 * 1/2012 Barney ..... A63F 13/31 345/158
9,579,587 B1 * 2/2017 Chen ..... A63H 33/009
10,065,127 B1 * 9/2018 Honeck ..... A63H 33/26
10,376,803 B2 8/2019 Honeck et al.
10,500,518 B2 * 12/2019 Graves ..... A63H 33/009
(Continued)

*Primary Examiner* — Eugene L Kim
*Assistant Examiner* — Matthew B Stanczak
(74) *Attorney, Agent, or Firm* — Boyle Fredrickson SC

(57) ABSTRACT

The present disclosure provides an inflatable toy sword device with a blade configured to extend from and retract into the handle. A flexible blade material may be stored in a spooled configuration within the handle and inflated during extension. During retraction, the process is reversed and air is controllably released while the material is spooled. A method of extending and retracting the flexible blade material of an inflatable toy sword is also provided.

34 Claims, 13 Drawing Sheets

(56) References Cited

U.S. PATENT DOCUMENTS

| | | | | |
|---|---|---|---|---|
| 10,758,835 | B1 * | 9/2020 | Kaye | A63H 27/10 |
| 11,484,810 | B2 * | 11/2022 | Faivre | A63H 33/22 |
| 2007/0270077 | A1 * | 11/2007 | Woodhouse | A63H 33/009 446/473 |
| 2008/0051003 | A1 * | 2/2008 | Hom | A63H 33/22 446/485 |
| 2008/0220693 | A1 * | 9/2008 | Cuisinier | A63H 33/009 463/43 |
| 2010/0048097 | A1 * | 2/2010 | Ma | F21S 4/22 446/485 |
| 2015/0126260 | A1 * | 5/2015 | Lynch | A63F 13/245 463/8 |
| 2015/0314213 | A1 * | 11/2015 | Zhou | A63H 33/22 446/485 |
| 2015/0375100 | A1 * | 12/2015 | Kaye | A63F 9/24 273/454 |
| 2016/0008730 | A1 * | 1/2016 | Stubenfoll | A63H 33/22 446/170 |
| 2018/0326317 | A1 * | 11/2018 | Honeck | A63H 33/26 |
| 2019/0022542 | A1 * | 1/2019 | Graves | F21V 14/00 |
| 2022/0203252 | A1 * | 6/2022 | Fahmie | A63H 33/009 |
| 2022/0410026 | A1 * | 12/2022 | Sacha | A63H 33/22 |
| 2023/0390661 | A1 * | 12/2023 | Pinkham | F21V 33/008 |

* cited by examiner

INFLATABLE, EXPANDING SWORD

CROSS REFERENCE TO RELATED APPLICATION

This application claims priority to U.S. provisional application Ser. No. 63/216,069, filed Jun. 29, 2021, the entire contents of which is incorporated by reference

BACKGROUND OF INVENTION

1. Field of the Invention

The present invention relates generally to sabers and more specifically it relates to an inflatable, extending, and retracting sword for novelty use as a toy sword, prop or for simulated combat. A method of using such a device is also provided.

2. Discussion of the Related Art

Simulated weapons, such as swords are frequently used as children's toys, theatrical props and combat training aids. Some such simulated weapons are designed to include specific functional components and ornamental appearances in order to replicate weapons from fictional or non-fictional stories and genres. For example, a toy sword that is intended for use in a theatrical production of an Aurtherian legend may include functional and ornamental aspects that are indicative of the sword Excalibur. Alternatively, if the toy sword was an accessory to a samurai costume, the sword may include functional and ornamental aspects that are indicative of a Japanese katana. In the genre of science fiction, many characters utilize swords that include a retractable blade formed of energy and/or light that selectively extends from the handle. The fictional nature of such devices renders accurate simulation of the functional components and ornamental appearances difficult.

Prior attempts to replicate such devices have included an apparatus of two-piece construction, where the rigid elongated blade is selectively attached to the handle or hilt by the user. Alternatively, some devices have utilized a telescopic blade that reduces, but does not eliminate the visible appearance of a portion of the blade when in the retracted configuration. However, all such devices fail to provide an accurate simulation of the blade extension and retraction.

In an effort to remedy these deficiencies, more recent attempts to replicate such energy swords have included the use of LED strips disposed on a flexible substrate that are mechanically driven between extended and retracted configurations. However, such devices are exceedingly delicate and not well suited for use in simulated combat. As such there remains a need for a device that both accurately simulates the extension and retraction of a science fiction energy sword while also being well suited for use in simulated combat and play.

Accordingly, the present invention addresses this long felt need by providing a toy sword which includes in at least one embodiment a blade chamber, handle or hilt, blade, switch, pump, battery, electric motor or motors, and controller.

SUMMARY OF THE INVENTION

In accordance with a first aspect of the invention, this need is satisfied by providing an adjustable sword apparatus configured for use in simulated combat that includes a housing having a sidewall extending between opposing first and second ends, an inflatable blade having a flexible wall extending between a first connected end affixed within a void defined by the sidewall of the housing and an opposing second end that is movable relative to the connected end. The apparatus includes an extension system disposed within the void that is configured to inflate an interior of the blade such that the second end of the flexible wall extends outwardly from the void in the housing, and a retraction system disposed within the void configured to retract at least a portion of the blade within the void.

A nonlimiting feature of this embodiment is to provide an inflatable expanding sword for novelty use as a toy or prop in simulated combat.

Another aspect of the invention is to provide an apparatus comprising a power source and a controller in electrical communication with the extension system and the retraction system, the power source and controller disposed within the housing void.

A nonlimiting feature of this embodiment is to provide a power source located in the apparatus for activating the blade extension and retraction systems.

Another aspect of the invention is to provide an air pump activated by the controller, the air pump in fluid communication with the interior of the blade and configured to provide positive air pressure to the interior of the blade upon activation.

Another nonlimiting feature of this embodiment is to provide an inflatable, expanding sword that contains significant pressure to hold shape while being swung.

Another aspect of the invention is to provide a motor activated by the controller and a lead extending between the motor and the second end of the flexible wall of the blade, the motor configured to retract the lead and the second end of the flexible wall upon activation.

Another nonlimiting feature of this embodiment is to provide an inflatable, expanding sword that has a blade that returns back into the housing when retracted.

In accordance with a another aspect of the invention, an adjustable saber apparatus configured for use in simulated combat is provided that includes a housing having a sidewall extending between opposing first and second ends, a pressurizable blade having a flexible wall extending between a first connected end affixed within a void defined by the sidewall of the housing and an opposing second end that is movable relative to the connected end. The apparatus includes a control circuit disposed within the housing, including, a power supply, an extension system that is configured to inflate an interior of the blade such that the second end of the flexible wall extends outwardly from the void in the housing, a retraction system configured to retract at least a portion of the blade within the void, and a controller.

In accordance with a another aspect of the invention, an inflatable device is provided that includes a rigid housing affixed to a generally cylindrical inflatable portion formed of a flexible high-tensile strength material configured to move between an expanded configuration and retracted configuration. The inflatable portion is generally contained within a void disposed in the rigid housing when in the retracted configuration and extends outwardly from the void when in the extended configuration.

These and other features and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

Figure 1:
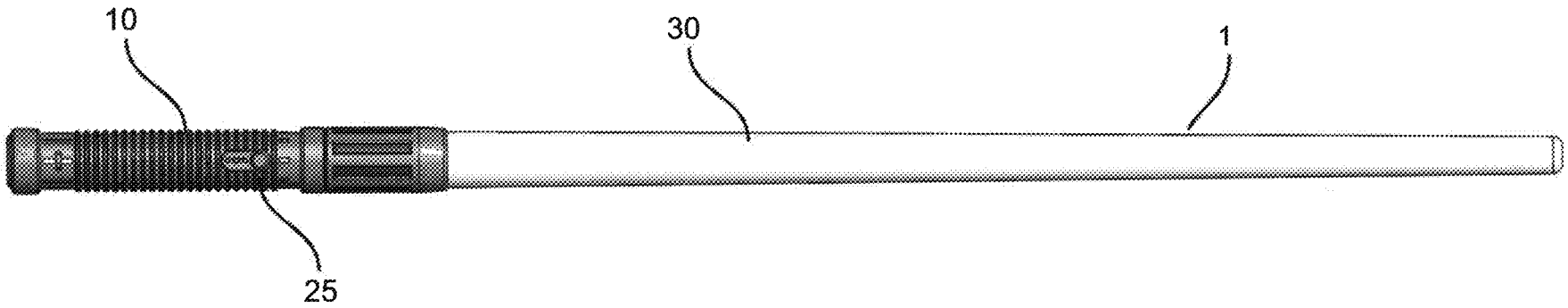
FIG. 1 is side plan view of the device according to one embodiment of the present invention in which the blade is in an extended configuration.
Figure 2:
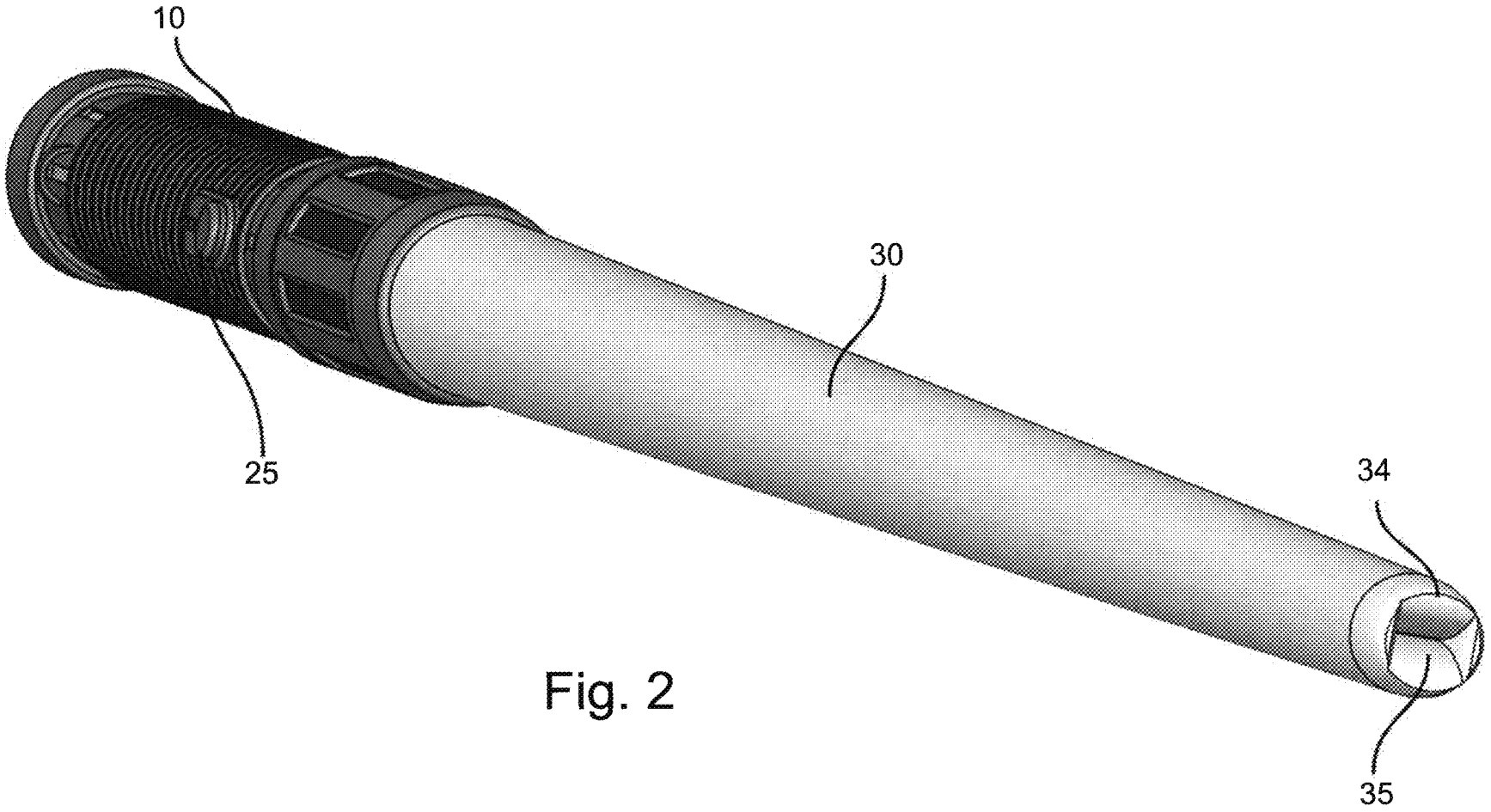
FIG. 2 is an isometric view of the device of FIG. 1, with the blade in an extended configuration.
Figure 3:
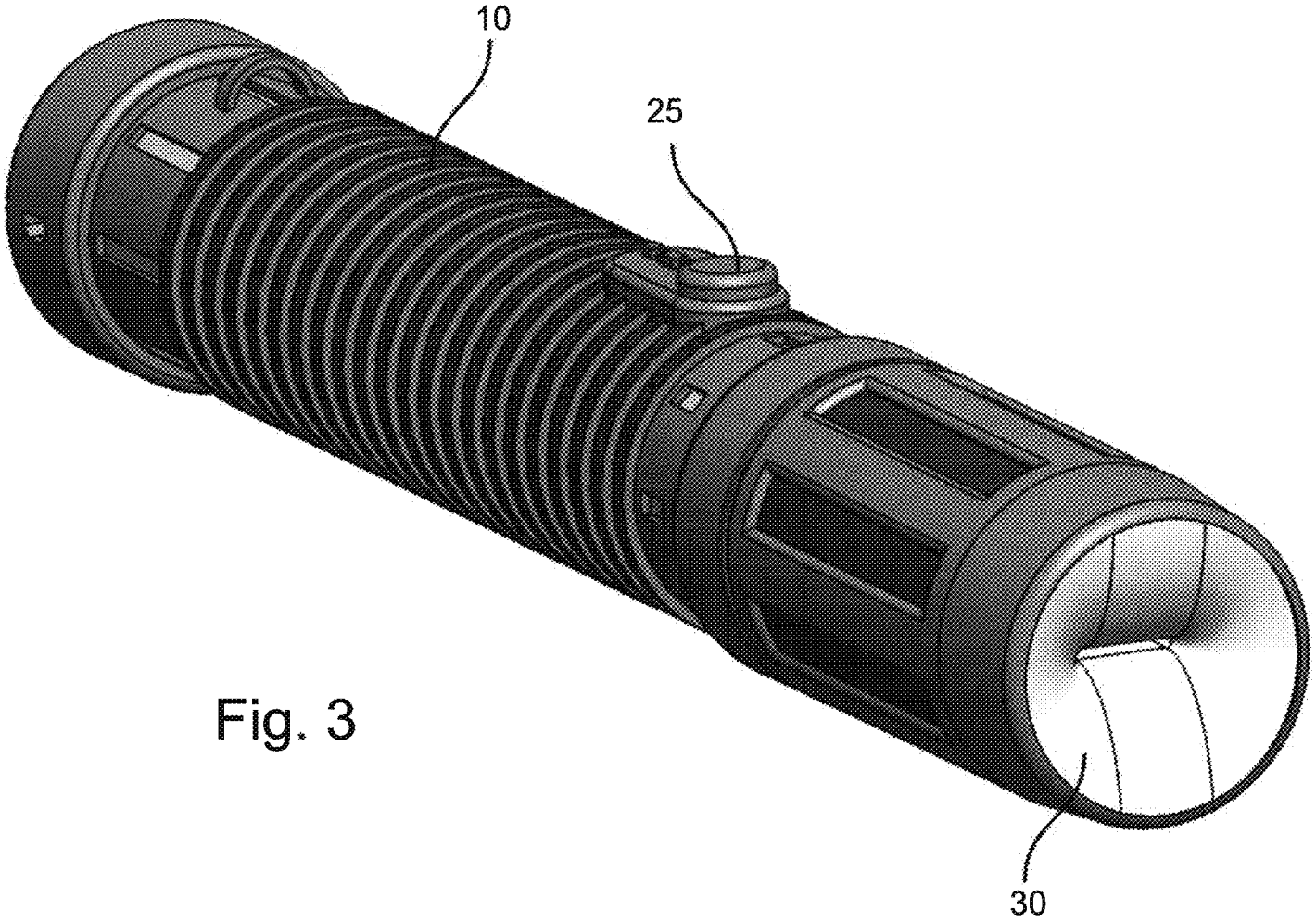
FIG. 3 is an isometric view of the device of FIG. 1, with the blade in a retracted configuration.

Referring now to the drawings, in which similar reference characters denote similar elements throughout the several views, the figures illustrate various components and embodiments of the present invention. In describing the embodiments of the invention which are illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the words "connected," "attached," or tennis similar thereto are often used. They are not limited to direct connection or attachment, but include connection or attachment to other elements where such connection or attachment is recognized as being equivalent by those skilled in the art.

The various features and advantageous details of the subject matter disclosed herein are explained more fully with reference to the non-limiting embodiments described in detail in the following description.

Referring now to FIG. 1 to 13, and initially FIG. 1, a sword or device 1 for simulated combat that has an expanding and retracting blade 30 is shown. During use, the blade 30 automatically expands or extends from the handle or hilt 10 and is then configured to retract back within. Once extended, the blade 30 is monolithic, which is to say fortited of a continuous outer surface that is preferable to a segmented blade. Moreover, the device 1 can be used for simulated combat when the blade 30 is in the extended configuration. Inflating the blade 30 above atmospheric pressure provides rigidity to an otherwise soft and flexible material making it less destructive in simulated combat, than blades formed of rigid plastic.

Figure 7:
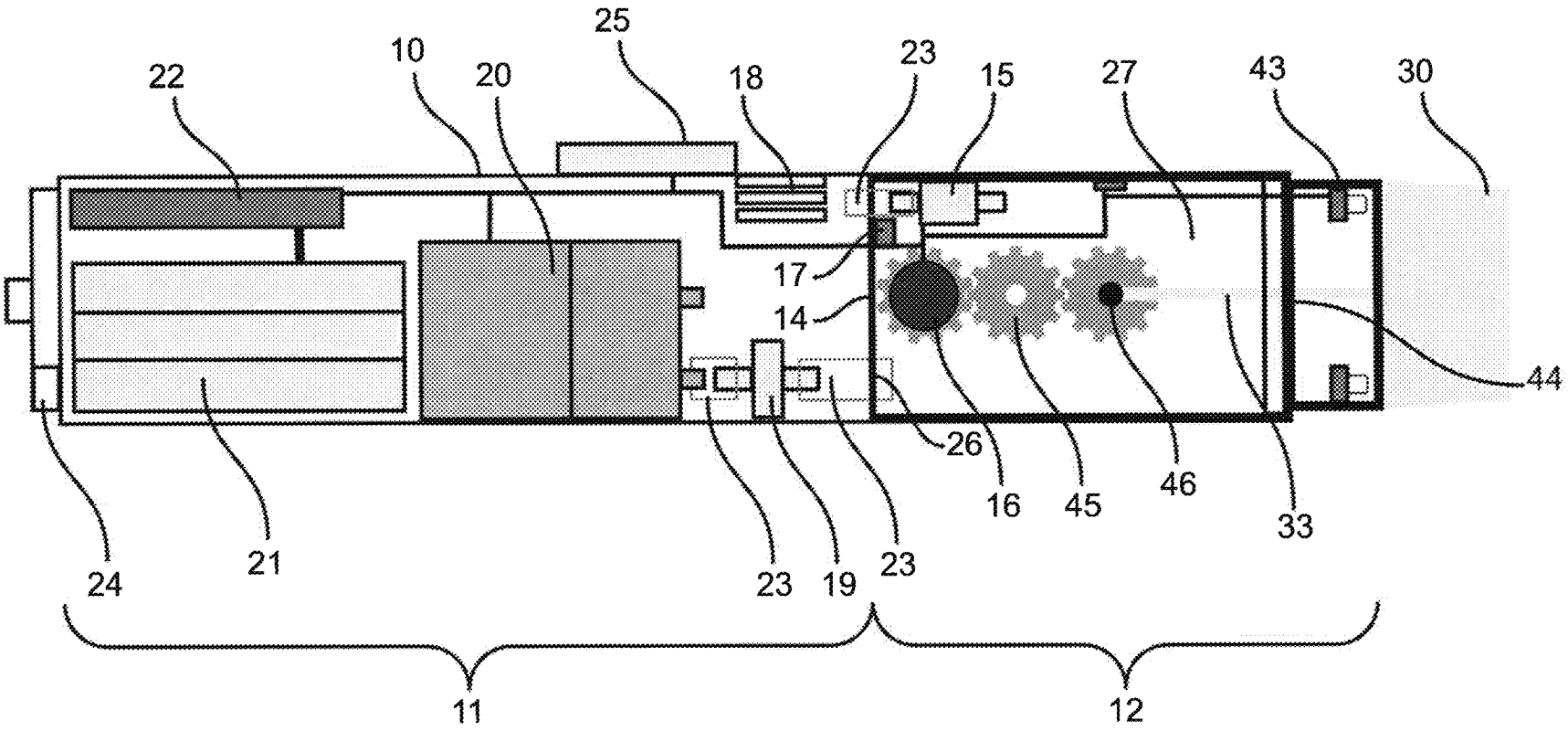
FIG. 7 is a cross sectional view of a handle of the device according to one embodiment of the present invention, in which the blade is in the extended configuration.
Figure 8:
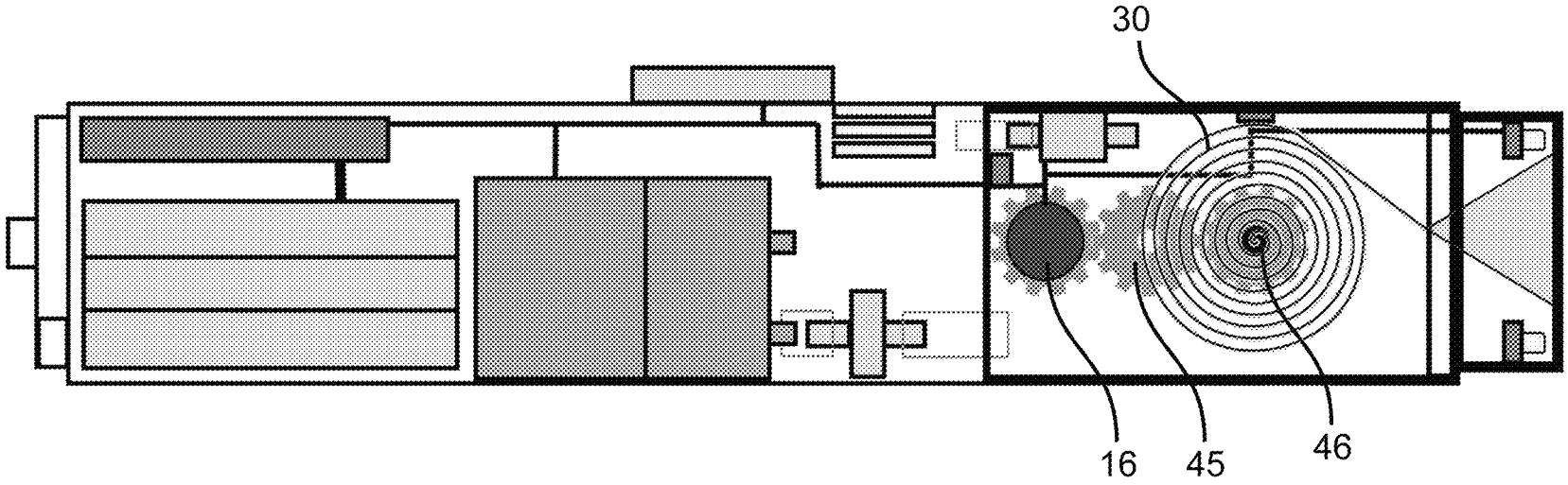
FIG. 8 is a cross sectional view of a handle of the device of FIG. 7, in which the blade is in the retracted configuration.

Generally, the housing 10, i.e., the handle or hilt, as may be used interchangeably herein, may contain all or most of the electromechanical components of the device 1. The rigidity of the housing 10 retains the internally housed components protected and firmly situated for use during simulated combat. As shown in FIGS. 7 and 8, a portion of the interior void 27 of the housing 1 defines a blade chamber 13 that connects to the blade 30 and is designed to hold pressure during operation of the device 1. In one embodiment of the present invention, the remaining portion of the housing 10, i.e. the interior void 27 that does not define the blade chamber 13 may not be pressurized above atmospheric pressure. When retracted, the blade 10 is stored or retained in the void 27 defined by the inner surfaces of the one or more walls of the housing 10 disposed within the blade chamber 13. The blade chamber 13 may be separated from the non-pressurized portion of the housing 10 by an airtight barrier 14. However, the blade chamber 13 may not define the entirety of the pressurized section of the housing 10. That is to say that the blade chamber 13 is configured with at least one opening 26 to receive air flow from the non-pressurized portion of the housing 10 through the airtight barrier 14. In this manner, the blade chamber 13 plays a role in the extension and retraction of the blade 30 as will be described in further detail below. When retracted, the blade 30 is situated in a void 27 within the blade chamber 13, such that at least the majority of the blade is recesses within the void 27.

Figure 4:
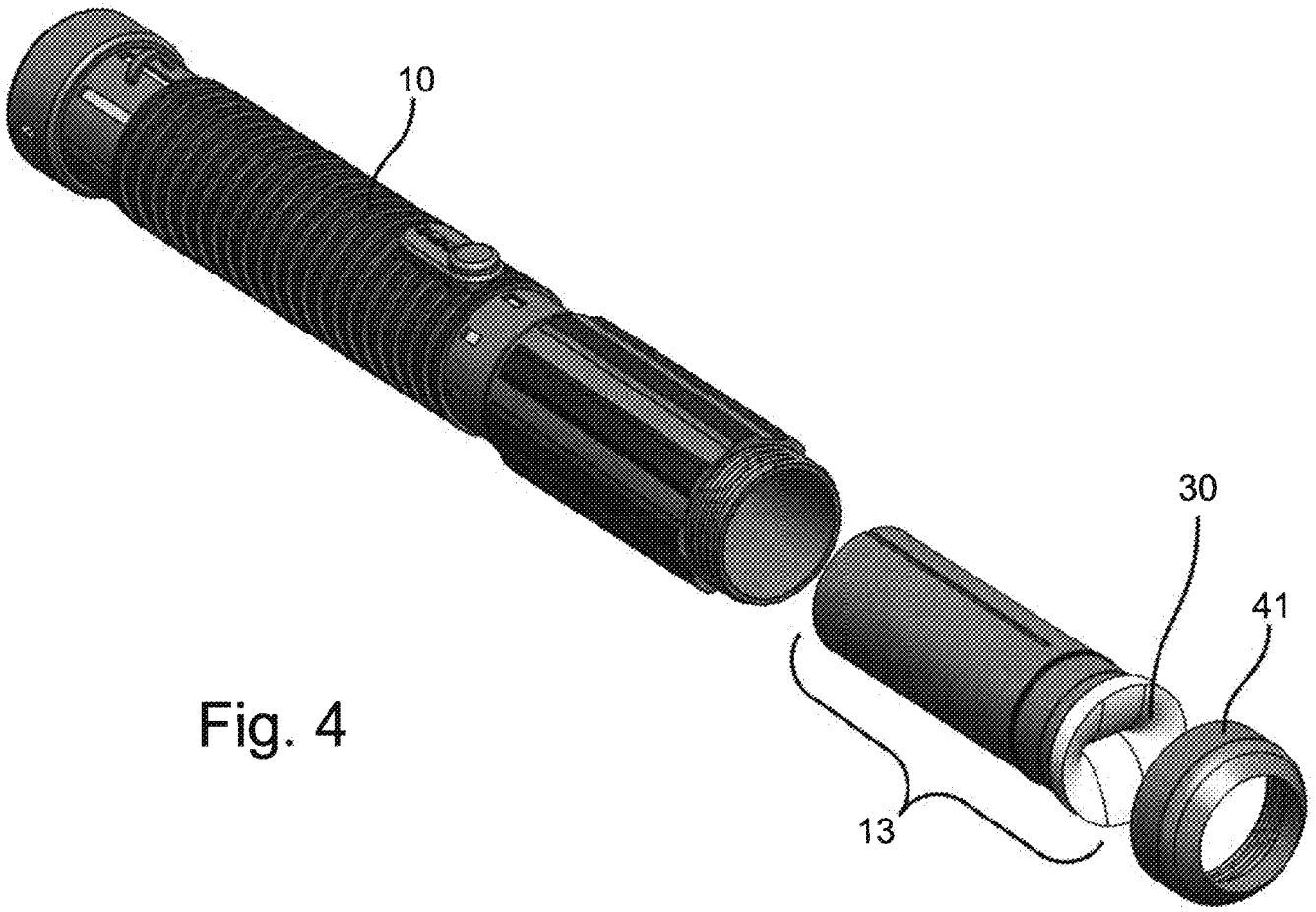
FIG. 4 is a partially exploded isometric view of the device of FIG. 1, with the blade in a retracted configuration.
Figure 5:
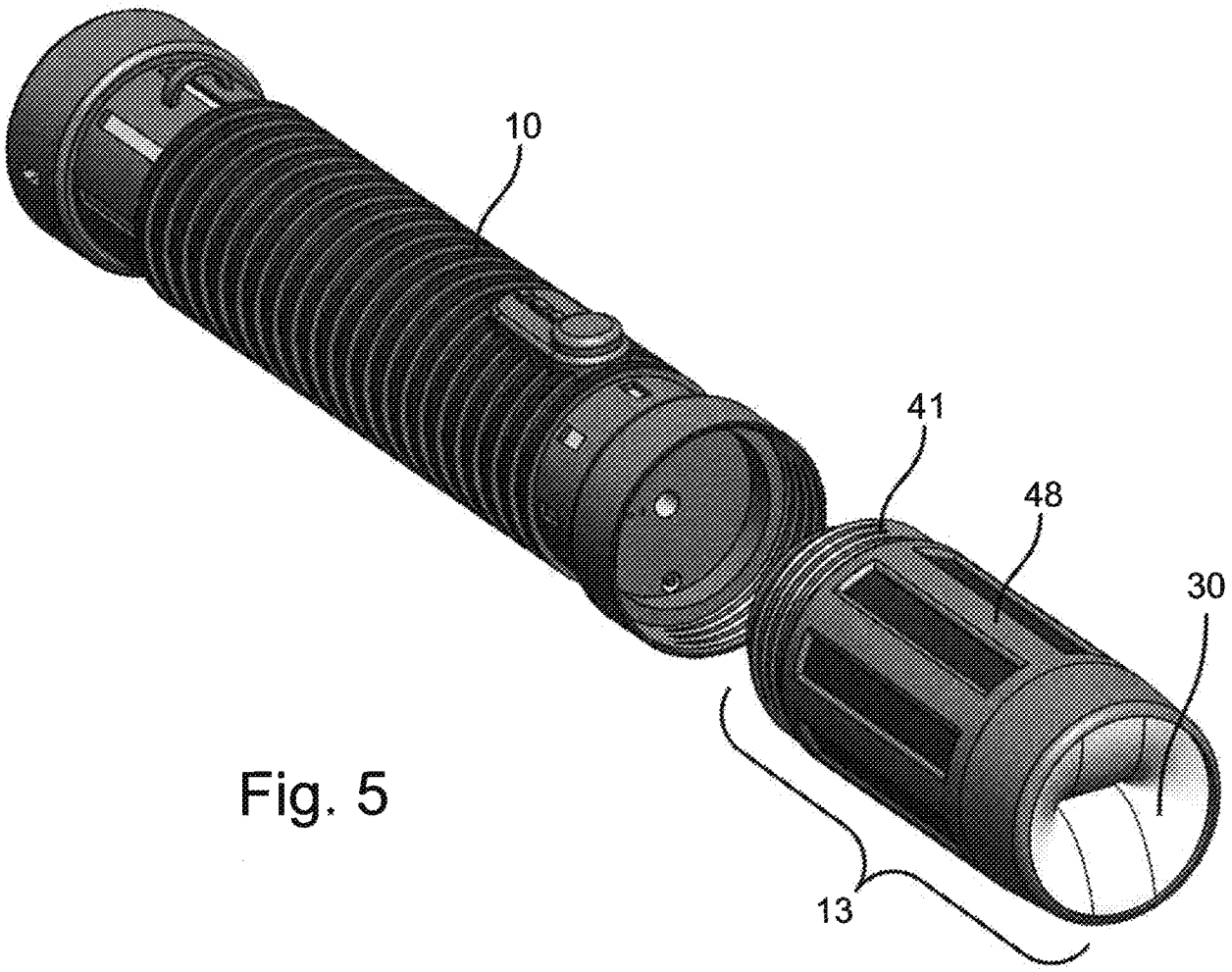
FIG. 5 is a partially exploded isometric view of an alternative embodiment of the device of FIG. 1, with the blade in a retracted configuration.
Figure 6:
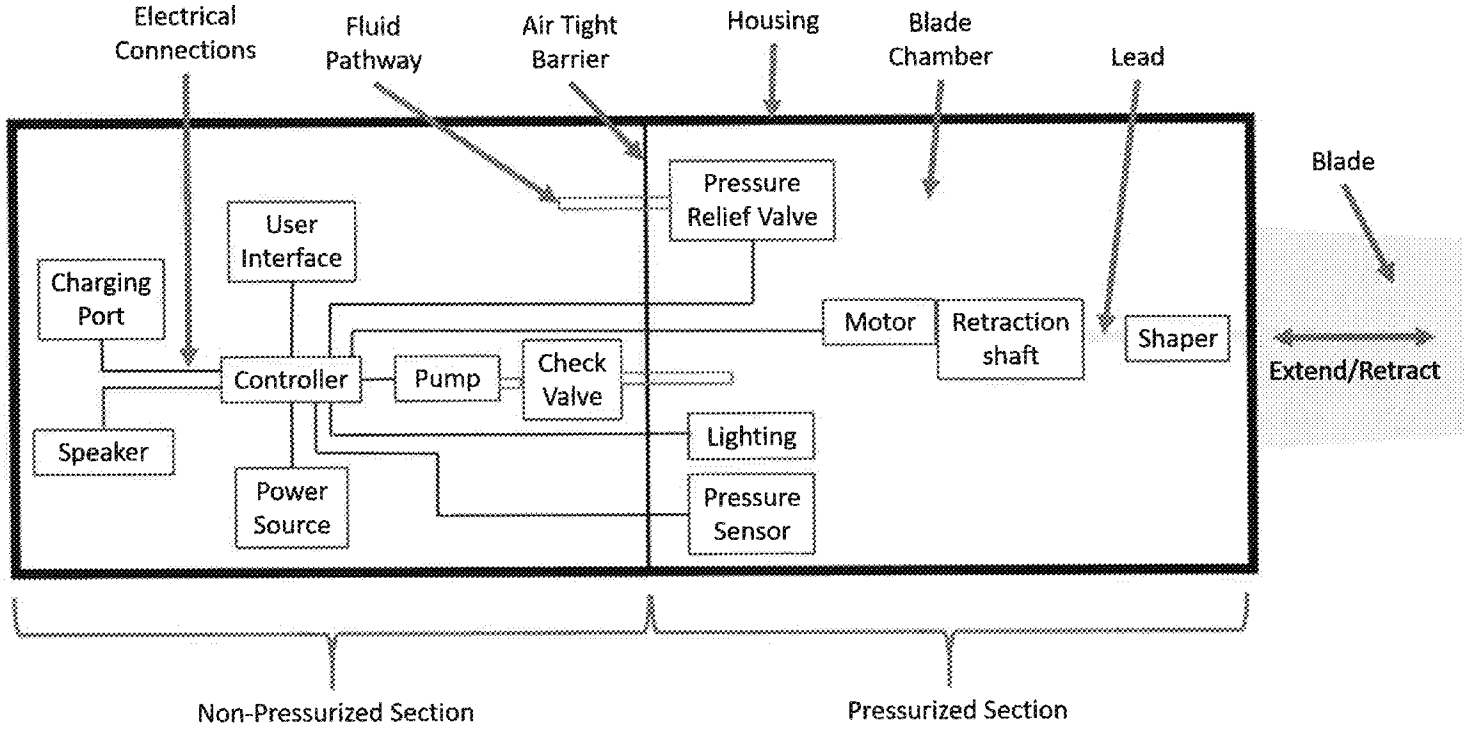
FIG. 6 is a schematic view of a handle of the device according to one embodiment of the present invention.

As shown in FIG. 5, the blade chamber 13 may be permanently affixed within the pressurized portion of the housing 10, or it may be releasably affixed. If releasably affixed, the blade chamber 13 may be inserted into a void in the pressurized portion of the housing 10 and affixed such that it will create an airtight seal from the atmosphere as depicted in FIG. 4. Alternatively, the blade chamber 13 may make up an external portion 48 of the pressurized portion of the housing and may detach from the remaining housing. FIG. 5 shows the two portions of the housing with blade chamber 13 detached from the pressurized portion. When attached, this portion of the housing 10 will form an airtight seal to the blade chamber 13, and an airtight seal from the atmosphere.

Figure 10:
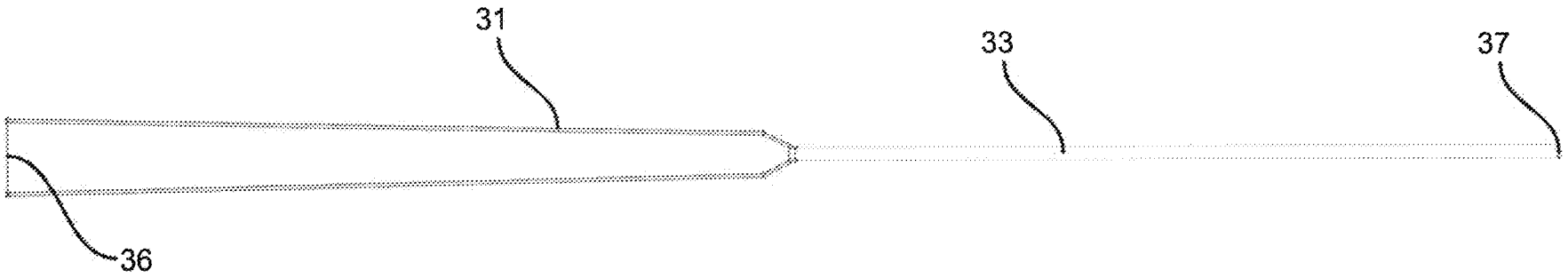
FIG. 10 is side plane view of a blade of the device according to one embodiment of the present invention, wherein the blade is disconnected from the handle and fully extended
Figure 13:
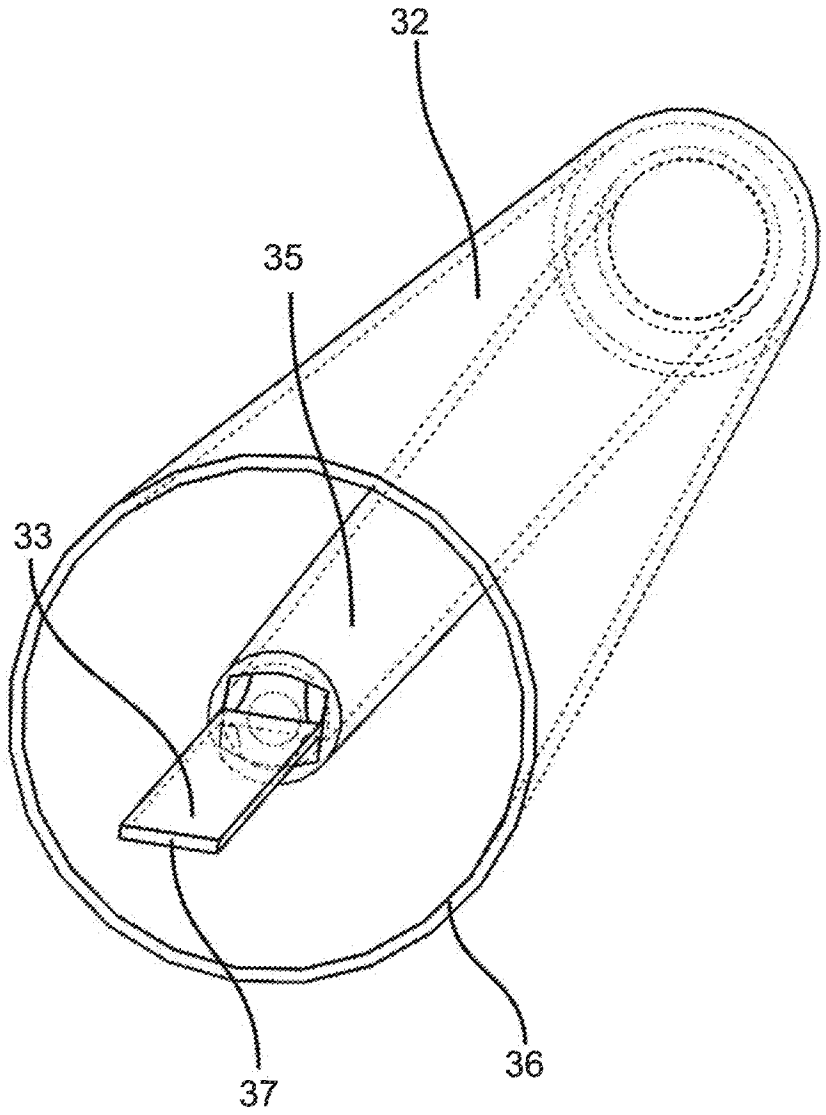

The blade 30, which will receive the majority of striking force during simulated combat and use of the device 1, is made to be a resilient inflatable structure. Accordingly, the blade 30 and its connection to the blade chamber 13 are configured to maintain positive air pressure, even when the blade 30 is struck against more rigid structures with generally harder or sharper surfaces such as: walls, furniture, wrist watches and plants. The blade 30 has an outer wall 32 that extends outwardly from the blade chamber 13. The outer wall 32 is generally cylindrical, but more preferably conical and/or tapered such that its circumference decreases along its length as the blade 30 extends further from the first end that is affixed to the blade chamber 13 until the blade 30 reaches a desired length. At the second end of the extended blade 30, which is located at a point between the opposed ends of the fully extended blade, as shown in FIG. 10, the wall 32 of the blade 30 folds inwardly on itself. As a result of this inward fold, as shown in FIG. 13, at the second end of the blade 30, the outer diameter of the blade 30 becomes an inner diameter. From the end of the inwardly projecting portion of the blade 30 is a lead 33 or tether, extends from the opposing second end, into the blade chamber 13. This configuration allows for an axial extension and retraction of the blade 30. The blade 30 is preferably made of a high tensile strength, highly flexible fabric or material that has a weight of preferably 4 to 310 denier.

While the first end of the lead 33 extends from the blade 30, the opposing second end of the lead 33 is affixed, and more preferably movably affixed, within the blade chamber 13. During extension, air pressure created by the pump 20 increases within the interior cavity of blade 30. This increased pressure forced the blade 30 to expand from within itself, unraveling away from the blade chamber 13. The outward extension from the housing 10 of the device 1 will stop as the lead 33 reaches its full length and is placed under tension. During use, in one embodiment the pump 20 may be activated at a lower flow rate to maintain desired positive pressure in the blade 30. Conversely, for retraction from the pressurized and extended shape shown in FIG. 2, the blade 30 is controllably depressurized as it is simultaneously retracted, e.g., rolled by the motor 16 into the blade chamber 13 by rolling or spooling of the lead 33 from its spool end 37. In one embodiment, the motor 16 is an electric DC motor that creates preferably between 100 and 500 kg-cm of torque and spools the lead 33 at a rate of 100-500 rpm, such that the retraction of the blade 30 occurs in preferably under 10 seconds. The top of the internal cone 35, referred to as the folding point 34 will begin to move down the length of the outer wall 32, towards the housing 10, as the spooling begins. Eventually, the entirety or majority of the blade 30 will be inverted and rolled into the blade chamber 13.

Extension and retraction of the blade 30 are controlled by a system of components that may work in tandem. By way of nonlimiting example, during extension of the blade 30, increased air pressure is created by a pump 20, as shown in FIGS. 6 through 9, to inflate and extend the blade 30. Extension of the blade 30 may also incorporate activation of the motor 16 to unspool or otherwise physically move the blade 30 out of the blade chamber 13. In another embodiment, the motor 16 may be placed in a neutral position during blade extension as to minimize drag on the blade 30 while it is extended, in the event that the motor is not reversed to apply active assistance in extension. Conversely, the retraction system may utilize the motor 16 to spool or roll the lead 33 and blade 30 into the blade chamber 13. Simultaneously, the blade 30 and blade chamber 13 may be controllably depressurized by a pressure relief mechanism 15. Alternatively, the retraction system may also incorporate use of the pump 20 if the pressure falls below the desired value for retraction, which is to say a set threshold of air pressure maybe maintained in the blade 30 during retraction such that the blade 30 does not undesirably wilt during retraction, but rather maintains its general cylindrical shape while retracting. Both systems may also incorporate a switch 25, power source 21, controller 22, sensors, fluid pathways 23, and check valve 19, as shown in FIGS. 6 through 9.

In addition to extension and retraction functions, the device 1 may also incorporate components that enhance the audio-visual experience during use of the device 1. By way of non limiting examples, these components may include lights, such as one or more LEDs, speakers, and sensors to detect motion and impact, some or all of which may be incorporated as part of the controller 22.

Still referring to FIGS. 6 through 9, the housing 10 or as it's more commonly known, the hilt or handle, will now be described in greater detail. The housing 10 houses the blade chamber 13, retracted blade 30, and electromechanical components of the device 1. The housing 10 preferably defines a plastic shell, likely of PC or ABS material that keeps the internal components firmly situated within. Alternatively, the housing 10 may also be constructed entirely or partially of metal, likely steel or aluminum if desired for higher durability or a specific aesthetic appearance. In most cases, the housing 10 will be generally cylindrical for ergonomics but may be many shapes and sizes that fit within a user's hand or hands. The housing 10 will preferably be 6 inches to 14 inches long and 1 inch to 3 inches wide, however it may be longer or wider in some embodiments such as a double bladed or staff saber. Furthermore, it should be understood that the shape of the housing 10 does not need to be cylindrical, can be curved or a multitude of other shapes. Multiple hilts can connect to one another at the bottom or sides of the housing 10 to form a staff or multiple blade saber. Other accessories may be designed to connect to the housing 10. It is also possible that the functional components of the devices are separated into two housings that are linked by a flexible connection, likely containing fluid pathways and/or electrical wiring. Such an embodiment may be preferable to reduce the size of the housing 10 that is held in the user's hands.

Within the housing 10, the power source 21, charging port 24 and controller 22 are preferably disposed at a second end opposite the blade 30. In such an embodiment, their location is within the non-pressurized portion of the housing 10. In one preferred embodiment, pump 20 is preferably situated between the power source 21 with its outlet directed towards the airtight barrier 14. The outlet of pump 20 is connected to a fluid pathway 23 which may be connected to check valve 19. In one embodiment, the pump 20 has a flow rate of approximately 5-50 liters of air per minute. Check valve 19 passively maintains the pressure built by the pump 20 from flowing back into the pump 20. The pressurized portion of housing 10 is configured to hold significant pressure until that pressure is released by the actuation of relief mechanism 15. Air intake 18 is preferably located near the inlet of pump 20 and the outlet and/or relief mechanism 15. Air intake 18 may be a perforated opening in the housing 10 that allows free flow of air inside and out of the housing 10. It is preferably large enough that pump 20 will not be starved for air while at peak function and as to not restrict the desired flow of relief mechanism 15. In one embodiment, as shown in FIG. 5, the housing 10 may define a set of two injection molded halves that screw or clip together. Disposed upon the outer surface of the housing 10 is a switch 25. Switch 25 can be placed anywhere along the housing 10, and is configured to activate extension and retraction of the blade 30 via the extension and retraction systems as described above.

Alternatively, the housing 10 connection to the blade chamber 13 may include an embodiment wherein the electric motor 16 is not separated by an airtight barrier from the non-pressurized portion of the housing 10, but rather has a connection through an airtight barrier with an airtight shaft configuration which attaches the motor driveshaft. Another embodiment may include the pressure sensor 17 connected directly to a fluid pathway between the check valve 19 and the airtight barrier 14. The blade chamber 13 may include other mechanical or electrical components, such as gears 45 or additional sensors.

Referring now to the blade chamber 13, which defines a portion of the housing 10 that connects to the blade 30 and is designed to hold pressure during extended blade operation of the device 1. In contrast, the remaining portion of the housing 10 is preferably not pressurized above atmospheric pressure. When retracted, the blade 30 is stored within a void 27 in the blade chamber 13. The airtight barrier 14 divides the housing 10 into a pressurized portion 11 on one side of the barrier and non-pressurized portion 12 on the opposing side of the barrier. The blade chamber 13 is positioned on the pressurized portion 12 of the housing 10. Various components will be disposed within the pressurized side of the airtight barrier 14. Most or all of the retraction mechanism will preferably be positioned within the pressurized portion 12 of the housing 10 since the blade 30 is both attached to the blade chamber 13 and stored in a void 27 within. The motor 16 is preferably positioned on the pressurized side of the airtight barrier 14, as it is easier to pass electrical current through the airtight barrier 14 than mechanical motion. However, it should be understood that the present invention is not so limited, and that location of the motor 16 within the nonpressurized portion of the housing 10 is well within the scope of the present invention. The motor 16 may also connect to other mechanical elements of the retraction system within the blade chamber 13, such as gears 45, belts, chains, a driveshaft, spool 46, or roller 47 to the extent present The pressure relief mechanism 15 can be placed on either side of the airtight barrier 14 with appropriate connections to a fluid pathway 23 passing through the airtight barrier 14. Likewise, the check valve 19 can also be placed on either side of the airtight barrier 14 with appropriate connections to a fluid pathway 23 passing through the airtight barrier 14. The pump 20 is preferably positioned within the housing on the non-pressurized side of the airtight barrier 14 so that it can intake air from the atmosphere. The pump 9 is connected to a fluid pathway 23 to the blade chamber 13 to create air pressure in the blade chamber 13 and blade 30. However, it is possible to place the pump 20 within the pressurized side of the airtight barrier 14 if there is a fluid pathway 23 connection through the airtight barrier 14 that opens to atmosphere.

The blade chamber 13 may be permanently affixed within the pressurized portion 12 of the housing 10, or more preferably it may be releasably affixed. Having a releasably affixed blade chamber 13 allows for replacement of a damaged blade 30 while retaining the comparably more mechanically complex, and theoretically undamaged, components within the housing 10.

If releasably affixed, the blade chamber 13 may be inserted into a void in the housing 10 and affixed in a manner that the connection will create an airtight seal from the atmosphere as depicted in FIG. 4. For example, the blade chamber 13 can be seated internally within the pressurized portion 12 of the housing and affixed therein by a threaded or locking collar 41 disposed at the first end of the housing 10, as shown in FIG. 4. Such an embodiment provides the additional benefit of maintaining the entirety or majority of the external surface of the housing 10 independent from the replaceable blade chamber 13. Therefore, a common replaceable blade chamber 13 may be used in multiple different housing 10 designs. The airtight barrier 14 that separates the pressurized portion 12 of the housing 10 from the non-pressurized portion 11 of the housing 10 may be affixed to the pressurized portion 12 or the blade chamber 13. When the blade chamber 13 is inserted, it will form a mechanical linkage with the housing 10. This linkage may be formed with an external threaded lock collar, screws, or other similar retaining structure. The blade chamber 13 itself may have integral threads or a quick connect design to easily attach to the main housing. Air seals, such as O-rings or an alternative resilient structure, may be present so that when affixed, the blade chamber 13 is pressurized with the pressurized portion 12 of the housing 10. The blade chamber 13 may be keyed to ensure proper orientation when inserted into the housing 10. The retraction system, such as gears 45, will need to mate properly when the blade chamber 13 is installed.

In an alternative embodiment, rather than the blade chamber 13 inserting into the housing 10 as shown in FIG. 4 and described above, a detachable blade chamber 13 may incorporate and define an external portion 48 of the housing 10 as depicted in FIG. 5. This embodiment provides the additional benefit of providing a blade chamber 13 that may be more durable as it is formed integrally with the outer surface of a portion of the housing 10, and/or provides an opportunity for the ornamental design of the housing 10 to be altered with a replacement blade chamber 13. When attached, the blade chamber 13 will form an airtight seal, closing the pressurized portion 12 of the housing and allowing for appropriate mating of the fluid pathways 23, electrical connections, and mechanical components of the retraction system to be made. The blade chamber 13 may be keyed or indexed to ensure proper orientation when attached to the housing 10. When the blade chamber 13 is attached, it will form a mechanical connection with the non-pressurized portion 12 of the housing 10. This connection may be formed with an external threaded lock collar, screws, or other similar retaining features. The blade chamber 13 itself may have integral threads or a quick connect design to easily attach to the housing 10. Air seals, such as O-rings, will be used so that when affixed, pressure can be raised and held to the desired value.

Turning now to FIGS. 10 thorough 13, the blade 30 will be described in further detail. The blade 30, which will receive the greatest about of wear and tear from receiving striking blows, is made to be a resilient inflatable structure. The blade 30 is preferably made of a high tensile strength, highly flexible fabric or material that is air impermeable, for example a nylon or polyester material. Air impermeability is preferably achieved with a thermoplastic polyurethane (TPU) coating disposed on or more sides of the flexible fabric or material. The TPU coating also allows for bonding or sealing to itself during the construction of the blade 30. The blade 30 is designed to maintain air pressure, even when hit against other inflatable blades or comparably harder and sharper objects. The blade 30 is preferably sealed at its connecting end 36 to the blade chamber 13 and in fluid communication with the pressurized portion 12 of the housing 10. The blade 30 is generally cylindrical, but more preferably conical. The blade 30 preferably has a length of approximately between 10 and 40 inches in length between the connected end 36 and the folding point 34 when fully extended, and a cross-sectional width of approximately 1 to 5 inches, and more preferably approximately 2 inches. As used herein the term approximately is understood to mean plus or minus 10%. The sidewall of the blade may be inclined at an angle of between 0.1° and 20° relative to a central longitudinal axis of the blade. Furthermore, the degree of taper may vary along the length of the blade 30. The blade 30 may have a conical outer wall 32 that extends from the outer diameter of the blade chamber 13. The outer wall 32 is preferably conical and has an outer circumference that decreases along the length of the blade as it travels further from the connecting end 36. The opposing end of the blade 34 when fully or partially extended defines a fold point 34, where the blade 30 folds inwardly, toward the center of the blade 30, causing the outer wall 32 to become an internal surface. At this opposing exposed end defined by the folding point 34 of the blade 30, the outer diameter is tensioned inward for a small section that forms a short conical inlet in the center. This portion is called the inner cone 35. The point at which the material bends at the second end and is redirected is defines the folding point 34. From the center of the inner cone 35 there is a lead 33 that extends down into the internal center of the blade chamber 13. The lead 33 may be a thin band of the same material the blade 30 is constructed of, or a different material such as a string or wire which engages the handle 10 as described above.

Figure 11:
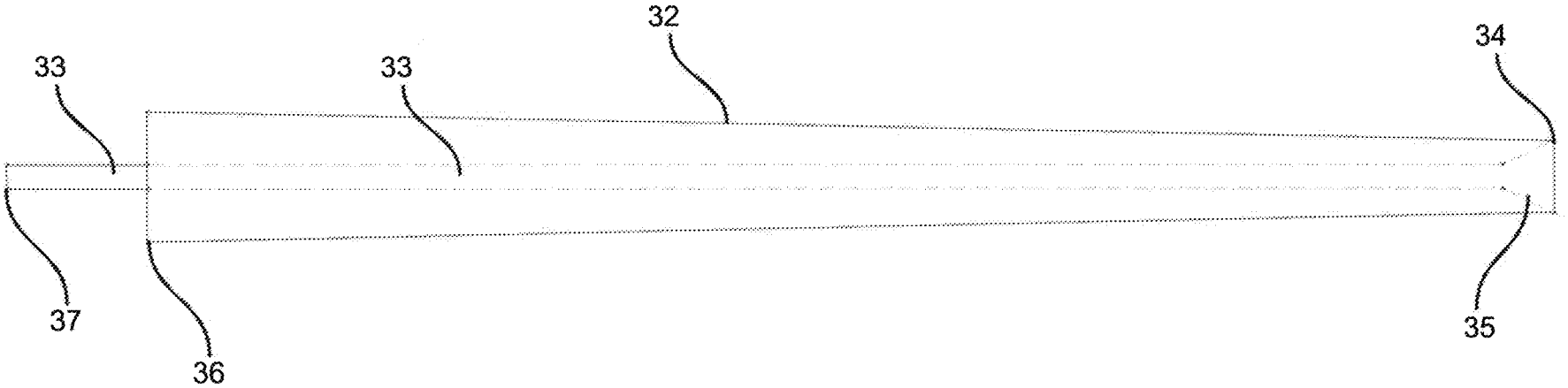
FIG. 11 is a side plane view of a blade of the device according to one embodiment of the present invention, wherein the blade is disconnected from the handle of the device and a portion of the blade is disposed internally and shown in broken lines.
Figure 12:
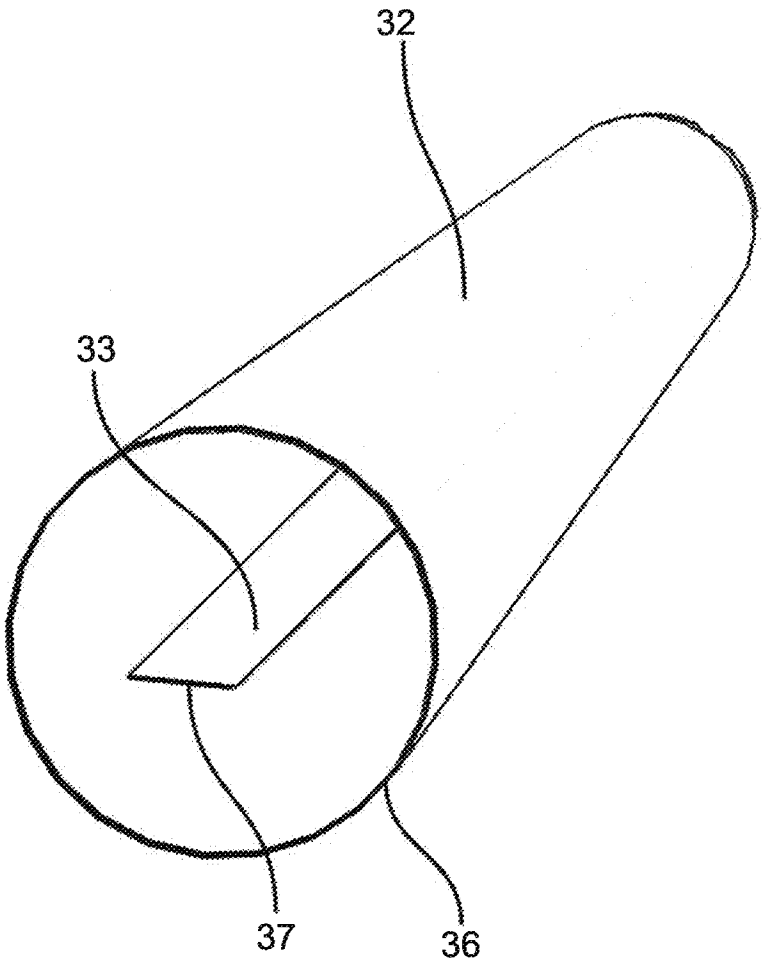
FIG. 12 is a isometric view of a blade of FIG. 11, wherein the blade is disconnected from the handle of the device and a portion of the blade is disposed internally and shown in broken lines; and, FIG. 13 is an isometric view of an alternative embodiment of the blade of FIG. 11, wherein the blade is disconnected from the handle of the device and a portion of the blade is disposed internally and shown in broken lines.

FIG. 10 illustrates an embodiment of the blade 30 fully extended and before it is inverted to attached to the blade chamber 13. Once the blade 30 is inverted over itself, sealed edge 31 will be internal to the outer wall 32. The specified length of the lead 33, from the spool end 37 to the inner cone 35, determines the length to which the blade 30 can expand. Air pressure will build within the blade 30, forcing it to extend from within itself, unraveling away from the blade chamber 13. The expansion outward from the device 1 will stop as the lead 33 reaches its full length and is placed under tension. From there, the inverted cone 35 extends to the folding point 34 where the material folds and becomes the outer wall 32, as is shown in FIG. 11. FIG. 11 also illustrates the connecting end 36 and spool end 37. The connecting end 36 is the location at which the outer wall 32 connects with the blade chamber 13 to create an airtight seal. FIG. 11 shows an isometric view of the second end of blade 30 in its expanded form, which depicts the lead 33 centered within the outer wall 32. It's preferable that the length of the outer wall 32 is drafted. The smaller end being at the folding point 34 and the larger at the connecting end 36. Such a tapered configuration provides ease of retraction into itself, ease of expansion from within itself, as well as increased line of sight for light emitted from internal LEDs to the internal surface of the blade 30's outer wall 32.

In an alternative embodiment, the inner cone 35 may extend fully or most of the way to the spool end 37 and define the lead 33. FIG. 13 shows this alternative embodiment. Such an embodiment may give the blade 30 increased rigidity and reduce the volume that is pressurized within the blade 30. Such a reduced in interior volume of the blade 30 would correspondingly reduce the time to full expansion and pressurization of the blade 30.

Turning now to FIG. 8, one system and method of retraction of the blade 30 within the blade chamber 13 is illustrated. That is to say, from its pressurized/extended shape in FIG. 2, the blade 30 is controllably depressurized as it is rolled into the blade chamber 13 by rolling of the lead 33 from its spool end 37. The top of the inner cone 35, referred to as the folding point 34, will begin to move down the length of the outer wall 32, towards the connected end 36, as the spooling begins. Eventually, the entire blade 30 will be inverted and the majority of its length rolled into the blade chamber 13.

In another system and method of retraction, the lead 33 is rolled as previously described but the outer portion of the blade 30 collapses down as it retracts in the manner consistent with a compression spring. The compressed outer blade fits down into a void 27 within the blade chamber 13 or housing 10. In this embodiment, a spring or lattice like structure could be coupled to the blade to aid in guiding the retraction so the blade 30 collapses desirably, or to add rigidity when extended. A lattice structure (not shown) could be configured similar to an isokinetic expanding hinged sphere, i.e., Hoberman sphere, arranged instead in a cylindrical shape. In another embodiment, the lead 33 may be comprised of a spring metal or spring plastic that rolls flat but when extended has shape memory to form a rigid member, much like a tape measure. In another embodiment, the lead 33 may be comprised of a coil spring, flat spring, or shape memory alloy that extends upon extension of the blade 30. One end of the spring would be affixed in the blade chamber 13, while the other end is affixed or positioned at the second end of the blade 30. The spring may be configured to maintain an opposing return force applied to the folding point 34 of the blade 30 to aid in retraction of the blade 30. The spring may alternatively be configured to maintain opposing expanding force while the blade 30 is retracted to aid in extension of the blade. In another embodiment, the lead 33 may be spooled and coupled to a torsion spring that maintains a return force while the lead is fully extended to aid in retraction when air pressure is removed. The lead 33 can be a string or different thicknesses for weight or size reduction or even increased tensile strength. The lead 33 could potentially be elastic for increased recovery to its desired shape when the blade 30 shape is deformed from impact.

Other embodiments include of the blade 30 as described above may include or incorporate different colors, lengths and blade shapes. Such variable colors may include translucency. The blade 30 could be colored instead of white to help with color visualization. This may be necessary for use in brightly lit areas or to make a lower cost device that is not able to use LEDs of sufficient brightness as to fully illuminate the blade 30 when fully extended. It is also considered within the scope of the present invention to have printed patterns, textures, layers or multiple types of materials on the blade 30 to further improve the visual effect of device 1

As indicated above, while blade 30 with a conical shape aids in expansion and retraction, other shapes are considered well within the scope of the present invention in order to achieve a specific visual look, including cylindrical, curved, square, or flat blades 30 which can be made using internal structures that connect to opposing inner blade walls to hold a flatter shape while staying out of the way of the retraction system. Alternatively, a flat blade could be formed using two pressurized tubes with additional material spanned between them. The device may incorporate a multitude of blades. One embodiment incorporating multiple blades would be a dual bladed device with blades extending from opposite ends of the housing 10. This embodiment may require additional internal components, such as a second pump and additional sensors, retraction motors, etc. Another multiple blade embodiment would include small blades extending out perpendicular to the main blade 30 forming a hilt guard. These smaller blades may have retraction components similar to the main blade 30, a retraction shaft coupled to a motor, a retraction shaft that is spring loaded, or may function more simply using elastic center leads or tensile springs to retract when air pressure is released. The housing of a multi-blade device may be separable, joinable, foldable, or otherwise assembled in a way to match a desired style and configuration.

As indicated above, blade retraction is performed by an interworking system of components. One embodiment of the system includes a spool 46 which is attached to the lead 33 of the blade 30. FIG. 8 illustrates such an embodiment, in which the blade 30 is rolled around the spool 46. The opposite end of the blade 30, i.e., end 36 is connected to the top of the blade chamber 13 and creates an airtight seal. Retraction of the blade in such a system may utilize both the release of pressure and the mechanical movement of the spool 46 by means of the motor 16.

Figure 9:
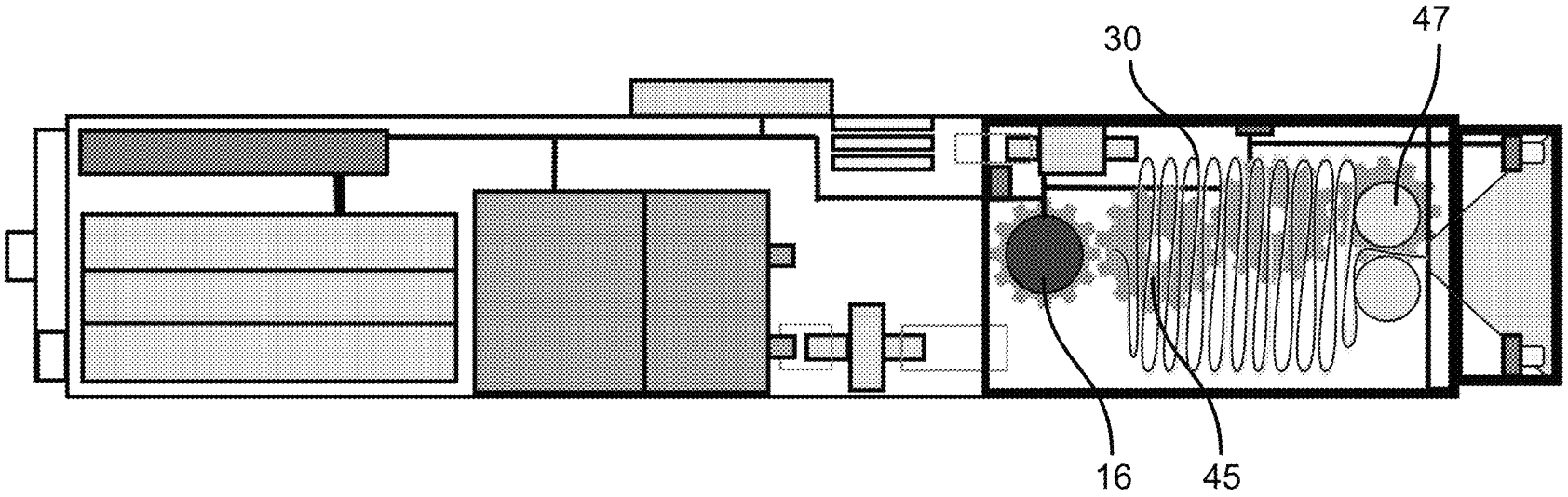
FIG. 9 is a cross sectional view of a handle of the device according to an alternative embodiment of the present invention, in which the blade is in the retracted configuration.

In another system and method of retraction, one or more rollers 47 are positioned such that they pinch and then pull the lead 33 and then blade 30 into an internal void 27 when they are bunched. The rollers 47, which may include one or more actively driven rollers and/or one or more passive following rollers may exert sufficient force onto the blade 30 to grip the blade 30 and are sufficiently compliant as to adapt to the changing thickness as retraction progresses from the lead 33 to the outer wall 32. The rollers 47 may be round in shape as shown in FIG. 9 or have a gear or other shape to aid in gripping the blade 30.

The motor 16 of the device 1 is in a mechanical connection to the retraction components, which may take the form of either the spool 46 or the rollers 47. One embodiment of transmitting mechanical power is a set of gears 45, with the first gear on the output shaft of the motor 16, the final gear on the spool 46 or rollers 47, and any necessary gears 45 between to achieve the desired orientation, distance, and rotation speed. FIGS. 7 through 9 illustrate the span of these gears 45. Other methods of connection, such as a driveshaft, pulley and belt, chain and sprocket, or a combination of a multitude of the aforementioned structures are also considered within the scope of the present invention.

Within the blade chamber 13, there may also be a structure or structures referred to herein as the shaper or blade guide 44. The purpose of the blade guide 44 is to orient the blade during retraction. There may also be a multitude of blade guides 44. The blade guide 44 could be for merely centering the blade 30 relative to the interior of the housing 10 during retraction. Alternatively, the blade guide 44 may fold the edges of the blade 30 before rolled or fold the entire blade 30 in half. Such shaping of the blade prior to retraction may reduce the width and allow the blade 30 to be rolled within a smaller diameter blade chamber 13.

During retraction of the blade 30, it is desirable to maintain some air pressure in the blade 30 during retraction to keep the blade 30 straight, and prevent wilting. Therefore the pump 20 may also be engaged at a controlled rate during retraction. The controller 22 may determine when the blade 30 is fully retracted in a multitude of ways as to trigger deactivation of the retraction system. The controller may monitor current to the retraction electric motor 16 to detect a stall. Alternatively, a sensor on the blade 30 or a trigger that pairs with a sensor in the blade chamber 13, such as a hall effect or optical sensor, that will signal full retraction, or a sensor in the housing 10, such as optical or IR proximity, can determine when the blade 30 is fully retracted, and single the controller 22 accordingly.

During use, extension of the blade 30 is primarily driven by the pump 20 increasing air pressure in the blade chamber 13 and blade 30. As air pressure fills blade chamber 13, the rolled blade 30 being a highly flexible material will innately conform to exert internal pressure outward toward lower atmospheric pressure. Since there is only one direction that the blade 30 it can expand, i.e. through the open first end of the housing 10, the blade 30 will begin to unravel from within, extending the folding point 34 from the pressure chamber 13 to its full length opposite the connecting end 36. The motor 16 may also be engaged in the reverse direction to help unspool or otherwise actively move the blade 30 out of the blade chamber 13. If the motor 16 has sufficiently low resistance, it may spin freely to allow the blade 30 to extend without electrically engaging the motor 16. Alternatively, the motor 16 may be mechanically decoupled from the retraction mechanisms to remove any resistance during extension. Extension will continue until the device 1 determines that the blade 30 is fully extended and the desired air pressure is achieved within the interior of the blade. Desired pressure is preferably in the range 3-30 and more preferably 3-20 psi, and can be determined with a pressure sensor 17 or switch. It may also be possible to measure the current of the pump 20 to determine when the pump 20 has reached the maximum pressure it can achieve, or by using a timer knowing that the pump will max out at the correct pressure. Complete blade 30 extension can be determined by a sensor on the blade 30 or a trigger that pairs with a sensor in the housing 10, such as a hall effect or optical, that will signal when fully extended, or a sensor in the housing 10, such as optical or IR proximity.

Turning now to FIGS. 6 through 9, the power source 21, is configured to fit within the housing 10. The power source 21 is directly connected to the controller 22 which is in electrical communication with the remaining electrical components of the device 1. The power source 21 is preferably a rechargeable (secondary) lithium ion battery, composed of either a cylindrical cell or cells or a polymer pack. The battery size and chemistry selected is configured to provide sufficient current to satisfy the electrical current draw of the pump and the electric motor. The battery may be comprised of one or more cells to achieve the required voltage and capacity for operation. The battery may be removable from the hilt for charging or replacement. Alternatively, other battery types may be used including nickel-metal hydride (Ni-MH) or nickel cadmium (NiCad), however these are no longer as popular due to lower performance compared to lithium ion. Charging of the power source may be achieved by connecting a power supply via a cable to an external charging port 24 on the hilt, a charging base or connector that connects via contacts externally mounted on the hilt, or a charging base or connector that wirelessly charges via induction. Alternatively, non-rechargeable primary cells can also be used to power the device to allow replacement instead of recharging. Alternatively, the power source may be comprised of a non-traditional battery type, such as a supercapacitor, or any emerging battery technologies.

As previously indicated, device 1 include an activation switch 25. The function of the device 1 relies on the user to turn it on and off. A main element of this activation/deactivation, i.e., extension and retraction of the blade 20 is the switch 25. The switch 25 is preferably embedded within the clamshell of the housing 10 and is preferably located just above the grip portion of the housing 10, where someone comfortably holding the device 1 could easily access it but will avoid incidental contact during simulated combat. The switch 25 location may change based on ornamental design of the housing 10. The switch is configured to power the device on and off, which coincides with the expansion and retraction of the blade 30. The switch 25 will be directly connected to the controller 22 to interface with its operation. The switch 25, attached to the outside of the hilt or within, is preferably activated from the outside of the housing 10 by the user.

The switch 25 may be an electronic switch that signals all functions to be performed by the circuitry. The electronic switch may be but is not limited to a push button, toggle switch, slider, rotary switch, capacitive switch, or pressure switch. The electronic switch may be momentary or hold an on-off position. The movement of the switch 25 may also be mechanically linked to perform a function within the housing 10. For example, movement of a slider switch may mechanically open or close an air release valve or move the motor into position to couple or decouple with the retraction components.

At least a second switch, dial, or similar user interface may also be added to make other adjustments to the function of the device, such as adjusting the LEDs activation, LED color, air pressure, or blade length, speaker volume, etc.

The motor 16, firmly affixed within the housing 10, is used in the extension and retraction of the blade 30. The motor 16, likely of cylindrical shape, is preferably located within the pressurized portion 12 of the housing 10 as previously indicated. The motor 16 will be controlled by the controller 22 and powered by the power source 21. The motor 16 will preferably be coupled to gears 45 to reduce the speed and increase the torque. The motor could be of brushed or brushless design. Alternatively, if the motor can be mechanically decoupled, or has sufficiently low free-spinning resistance, it may not be used during extension of the blade 20.

The controller 22 connects all the electrical components and runs basic firmware so the device 1 can operate as indicated herein. Located within the housing 10, the controller 22 will be firmly affixed as to avoid damage during simulated combat.

The controller 22 will feature numerous electrical parts common to operation of motors, LEDs, power source, speakers, and all other components included in the device 1. These parts may include, but are not limited to, some or all of the following: a voltage regulator, voltage step up (boost) circuit, battery monitoring and charging circuit, motor driver or drivers, LED driver or circuitry to control current and voltage supplied to LEDs, speaker controller, vibrator, motion sensing including accelerometer or gyroscope, circuit to read or communicate with the air pressure sensor, Bluetooth receiver/transmitter, NFC or RFID reader, and various electrical connectors. The speaker may be mounted on the controller 22 or mounted off board and connected with wires. The controller 22 will respond to user input via the switch 25 and motion and impact of the blade 30. The controller 22 may be interfaced by the user to change the color of the blade 30. Programming may be done by adjusting an internally or externally mounted switch or dial or buttons, wirelessly with Bluetooth and a connected app, memory card, or changed by the physical or wireless connection of different parts that the user will be able to swap within the housing 1. The blade 30 could be made of a conductive fabric that is connected electrically to the controller 22 so that it functions as a sensor to detect when it makes contact with another blade, which could be distinguished from contact with another object.

Programming of the controller 22 will account for all envisioned scenarios during use so that the device remains functional. For example, if the power source 21 is depleted during use the device 1 will be able to extend or retract a partially extended blade 30 when recharged. For another example, if a blade 30 is obstructed during expansion or retraction, it will stop inflating once it reaches set pressure even if partially extended, or will stop retraction if the controller 22 senses a motor stall. Constant monitoring of the state of the blade 30 could allow the controller 22 to resume extension or retraction once able, or the user could trigger extension or retraction to resume as desired. Error codes could be given to the user through LED indication, audio indication, or wireless communication with another device such as a cellphone.

There are several possible embodiments of the pressure relief mechanism 15. One possible embodiment is that the motor 16 used for retraction is also configured to move a pressure valve open and closed. This can be done with a cammed or toothed element operation when spinning in one direction. After the valve is open, the element could de-clutch as it spins to prevent damage. The valve could be spring loaded so that when the motor 16 stops spinning it closes. This operation of the air valve could also be controlled by a second electric motor that is not also being used for retraction.

One embodiment of the present invention includes an electric solenoid that directly opens and closes an air valve in fluid communication with atmospheric pressure. Other electric possibilities include an electric motor or electric stepper motor that opens a valve through turning motion (i.e. a ball valve, stop-cock or screw valve), or a linear stepper or actuator that slides a valve open and closed.

Another possible embodiment may include user actuation of the switch 25, which physically opens and closes an air valve. In such an embodiment, the switch 25 would further include adequate air seals to prevent leaking.

One system and method of lighting the blade 30 is an LED ring or array 43 that is situated at the base of the blade 30 within the blade chamber 13. The LEDs may be positioned circumferentially around the base of the blade 30 for even illumination, for example around locking collar 41. However, a smaller number of LEDs may be used so it may not resemble a ring. If the blade 30 is shaped differently from a cylinder or cone, the LEDs may not necessarily be arranged in a ring as to provide even illumination. A light diffuser may also be disposed adjacent the LEDs to achieve desired light distribution. Alternatively, it is possible to light the blade 30 with at least one centrally located LED behind the spool. The central location of the LEDs may be desirable to interact with optical or luminescent elements down the center lead 33 of the blade. The LEDs may be directed to emit light in line with the blade or directed at optical elements located therein. Optical elements, such as fiber optics may be included to further direct the light for full and even illumination of the blade. Optics could include lenses, collimators, filters, mirrors, diffraction elements, or fiber optics. Fiber optics may be incorporated into the construction of the blade 30 or lead 33 to improve light transmission. An additional light emitter may be affixed to the second end of the blade and oriented to emit light back down the blade to aid in full blade illumination.

Alternatively, the LEDs may be incorporated into the construction of the blade 30. LEDs may be mounted on the lead 33 and distributed down the length of the blade 30. The associated circuitry and wiring connecting the LEDs will be made flexible so that the blade 30 can still be rolled up or otherwise stored when retracted.

If the blade 30 is constructed of a translucent white or gray colored material, the LED color can dictate the illuminated color of the blade. LEDs may be of a single color or multiple colors that allow for adjustment of the output hue, i.e. RGB LEDs. Alternatively, the blade may be constructed of a translucent colored material which can be lit by colored or white LEDs. Blades may be constructed of a multitude of colored materials to achieve the desired visual effect.

The blade 30 material may also be constructed containing a photoluminescent material that reacts with the emitted light to enhance the lighting effect of the blade, or an electroluminescent material that emits light when an electrical current is applied. The blade may be constructed of varying densities, layers, or woven patterns that vary the light output for the desired visual effect.

A laser diode or diodes could also be used with the proper optical components. The beam would need to be split a multitude of times and projected in an even spread throughout the length of the blade for an even lighting effect. There may also be the addition of an o-ring lens or lenses above the LED's that have movements for optical effects.

Although the best mode contemplated for carrying out the present invention is disclosed above, practice of the above invention is not limited thereto. It should be understood that the invention is not limited in its application to the details of construction and arrangements of the components set forth herein. The invention is capable of other embodiments and of being practiced or carried out in various ways. Variations and modifications of the foregoing are within the scope of the present invention. It is also understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

We claim:

1. An adjustable sword apparatus configured for use in simulated combat, the apparatus, comprising:

a housing having a sidewall extending between opposing first and second ends, at least a portion of an outer surface of the sidewall configured to be grasped by a user;

an inflatable blade having a flexible monolithic wall extending between a first end affixed within a void defined by the sidewall of the housing and an opposing movable second end, an extension system disposed within the void of the housing configured to inflate an interior of the blade defined by the flexible monolithic wall such that the second end of the flexible monolithic wall extends outwardly from the void; and, a retraction system disposed within the void configured to retract at least a portion of the inflatable blade within the void.

2. The apparatus of claim 1, further comprising a power source and a controller in electrical communication with the extension system and the retraction system, the power source and controller disposed within the void.

3. The apparatus of claim 2, wherein the extension system comprises an air pump activated by the controller, the air pump in fluid communication with the interior of the blade and configured to provide a positive air pressure to the interior of the blade upon activation of the extension system.

4. The apparatus of claim 2, wherein the retraction system comprises a motor activated by the controller and a lead extending between the motor and the second end of the flexible monolithic wall of the blade, the motor configured to retract the lead and second end upon activation of the retraction system.

5. The apparatus of claim 1, wherein upon activation of the retraction system, a portion of the flexible monolithic wall proximal the second end is initially retracted into the void prior to a portion of the flexible monolithic wall proximal the first end.

6. The apparatus of claim 1, wherein upon activation of the retraction system, a portion of the flexible wall proximal the first end is initially retracted into the void prior to a portion of the flexible wall proximal the second end.

7. The apparatus of claim 1, wherein at least a portion of the blade is constructed of a flexible material having a cylindrical shape.

8. The apparatus of claim 1, further comprising one or more light emitters disposed within one or more of the void of the housing and the interior of the blade, the one or more light emitters in electrical communication with the controller.

9. The apparatus of claim 1, further comprising one or more speakers disposed within the void of the housing, the one or more speakers in electrical communication with the controller.

10. The apparatus of claim 1, further comprising a motor in electrical communication with the controller, wherein the motor is selectively operable to activate the extension system and retraction system.

11. An adjustable saber apparatus configured for use in simulated combat, the apparatus, comprising:

a housing having a sidewall extending between opposing first and second ends, at least a portion of an outer surface of the sidewall configured to be grasped by a user;

a pressurizable blade having a flexible monolithic wall extending between a first end affixed within a void defined by the sidewall of the housing and an opposing movable second end, a control circuit at least partially disposed within the void of the housing, the control circuit comprising:

a power supply;

an extension system configured to inflate an interior of the blade defined by the flexible monolithic wall such that the second end of flexible monolithic wall extends outwardly from the void;

a retraction system disposed within the void configured to retract the second end of the flexible monolithic wall within the void; and, a controller configured to selectively activate and deactivate the extension system and retraction system.

12. The apparatus of claim 11, wherein the blade is constructed of a flexible material a portion of which defines a cylindrical shape.

13. The apparatus of claim 11, further comprising a lead extending between the retraction system and the second end of the flexible monolithic wall of the blade, the retraction system configured to retract at least the lead and second end upon activation of the retraction system.

14. The apparatus of claim 13, wherein upon activation of the retraction system, a portion of the flexible monolithic wall proximal the second end is initially retracted into the void prior to a portion of the flexible monolithic wall proximal the first end.

15. The apparatus of claim 11, wherein upon activation of the retraction system, a portion of the flexible wall proximal the first end is initially retracted into the void prior to a portion of the flexible wall proximal the second end.

16. The apparatus of claim 11, wherein the control circuit further comprises one or more light emitters disposed within one or more of the void of the housing and the interior of the blade.

17. The apparatus of claim 16, wherein the flexible monolithic wall further comprises at least a portion of an outer surface that is configured to create a visible interaction with light generated from the one or more light emitters.

18. The apparatus of claim 16, wherein the control circuit further comprises one or more speakers disposed within the void of the housing.

19. The apparatus of claim 18, wherein the control circuit further comprises one or more motion sensors configured to generate a signal indicative of movement, and wherein upon receipt of the signal the controller activates one or more of the speakers and light emitters to generate an output therefrom.

20. The apparatus of claim 18, wherein the control circuit further comprises one or more contact sensors configured to generate a signal indicative of the pressurizable blade contacting an external structure, and wherein upon receipt of the signal the controller activates one or more of the speakers and light emitters to generate an output therefrom.

21. The apparatus of claim 11, wherein the retraction system is configured to pass the flexible wall between a pair of rollers.

22. The apparatus of claim 11, further comprising a guide disposed within the void between the retraction system and the second end of the sidewall that is configured to orient the flexible monolithic wall for retraction by the retraction system.

23. The apparatus of claim 11, further comprising releasable coupling disposed adjacent the first end of the pressurizable blade, wherein the coupling is configured to relesably affix the pressurizable blade to the housing.

24. The apparatus of claim 11, further comprising a pressure release mechanism in fluid communication with the interior of the flexible monolithic wall.

25. The apparatus of claim 11, wherein the extension system comprises an air pump in fluid communication with the interior of the blade and a check valve disposed between the air pump and the interior of the blade, the air pump configured to provide a positive air pressure to the interior of the blade upon activation of the extension system.

26. The apparatus of claim 11, wherein the control circuit further comprises a pressure sensor in fluid communication with the interior of the flexible monolithic wall.

27. The apparatus of claim 11, wherein the control circuit further comprises a blade position sensor.

28. The apparatus of claim 11, wherein the controller is configured to disengage the retraction system during activation of the extension system.

29. The apparatus of claim 11, wherein the housing further defines a first and second housing chamber, and a first portion of the control circuit disposed within the first housing chamber and a second portion of the control circuit disposed within the second housing chamber.

30. The apparatus of claim 29, further comprising an attachment mechanism disposed between the first and second housing chambers such that the first and second housing chambers are releasably coupled.

31. The apparatus of claim 11, further comprising a secondary housing coupled to the housing, wherein a first portion of the control circuit is disposed within the void in the housing and a second portion of the control circuit is disposed within the secondary housing.

32. The apparatus of claim 11, wherein the pressuraziable blade is one of a plurality of pressurizable blades.

33. The apparatus of claim 11, wherein a first portion of the void defines a pressure chamber in fluid communication with the interior of the flexible monolithic wall.

34. An adjustable saber apparatus configured for use in simulated combat, the apparatus, comprising:

a housing having a sidewall extending between opposing first and second ends, at least a portion of an outer surface of the sidewall configured to be grasped by a user;

a pressurizable blade having a flexible wall extending between a first end affixed within a void defined by the sidewall of the housing and an opposing movable second end, a control circuit at least partially disposed within the void of the housing, the control circuit comprising:

a power supply;

an extension system configured to inflate an interior of the blade defined by the flexible wall such that the second end of the flexible wall extends outwardly from the void;

a retraction system disposed within the void configured to retract the second end of the flexible wall within the void; and, a controller configured to selectively activate and deactivate the extension system and retraction system;

wherein the retraction system comprises a motor that is configured to spool the flexible wall about a rotatable shaft upon activation of the retraction system.

* * * * *